US005819847A

United States Patent [19]

Pinheiro et al.

[11] Patent Number: 5,819,847

[45] Date of Patent: Oct. 13, 1998

[54] ADAPTER FOR OIL WELL TUBINGS

[75] Inventors: Eliberto Eduardo Pinheiro; Manoel Gomes Filho, both of Rio de Janeiro, Brazil

[73] Assignee: Petroleo Brasileiro S.A.-PETROBRAS, Rio de Janeiro, Brazil

[21] Appl. No.: 671,617

[22] Filed: Jun. 28, 1996

[30] Foreign Application Priority Data

Nov. 29, 1995 [BR] Brazil ..... 9505555-0

[51] Int. Cl.[6] ..... E21B 17/14; E21B 43/12

[52] U.S. Cl. ..... 166/242.3; 166/313

[58] Field of Search ..... 166/117.5, 135, 166/242.3, 313, 369

[56] References Cited

U.S. PATENT DOCUMENTS

| | | | |
|---|---|---|---|
| 649,326 | 5/1900 | Losure | 166/68 X |
| 3,086,592 | 4/1963 | Hoch | 166/313 X |
| 3,172,469 | 3/1965 | Coberly | 166/313 X |
| 3,552,491 | 1/1971 | Thompson | 166/313 X |

*Primary Examiner*—George A. Suchfield

*Attorney, Agent, or Firm*—Sughrue, Mion, Zinn, Macpeak & Seas, PLLC

[57] ABSTRACT

An adaptor for oil well tubings interconnects two tubings in the interior of an oil well. Two types of adapters are provided, one for use when the two tubings are not installed at the same time and the other for use when the tubings are installed simultaneously. The first type has in its interior two bores to connect to the two tubings. The top end of the first bore in threaded to permit its connection to one of the tubings. The second bore has a diameter larger than that of the first to permit the insertion into its interior of the second tubing. The second type of adapter has in its interior two threaded bores to interconnect the two tubings. In both types of oil well tubing adapters, the bottom portion of the adapter has a 180° bend segment which permits communication between the two orifices, thus making intercommunication between the tubings possible. A connection in the bottom part of the adapter permits its interconnection to a tubing conducting the ascending flow of oil coming from the production region, this flow passing into the interior of the tubing adapter by way of orifices existing in the internal part of the connection. These orifices likewise prevent the passage of the mechanical interface to the bottom of the well, the occurrence of which would make it impossible to apply an intermittent production method with a mechanical interface.

7 Claims, 3 Drawing Sheets

ADAPTER FOR OIL WELL TUBINGS

FIELD OF THE INVENTION

The present invention relates to a tubing component situated in a region close to the bottom of an oil well and intended to interconnect two tubings and to permit the passage of a mechanical interface from one tubing to the other.

BACKGROUND OF THE INVENTION

The object of the present invention is to assist the interconnection of two oil well tubings, permitting the intermittent outflow of oil, occurring at times through one tubing and at other times through the other. This outflow is assisted by the passage of a mechanical interface, which is inserted into the surface of one of the tubings and returns to the surface via the other tubing.

PRIOR ART

When an oil well has been completed, the oil will flow out to the surface only if the static pressure is sufficient to overcome the back pressure exerted by the column of oil accumulated in the tubing. If the static pressure is not sufficient to overcome this back pressure, it then becomes necessary to use some artificial lifting method to bring about the outflow of oil to the surface.

Mechanical pumping systems, submerged centrifugal pumping systems, progressive cavity pumping systems, and pneumatic pumping systems ("gas lift") are some of the methods widely used in the petroleum industry. However, a more precise analysis of the subject shows that they all entail some technical difficulty, which may even in some cases make their use inadvisable. It thus becomes necessary to develop new methods which improve the oil recovery facilities of petroleum storage tanks.

The Brazilian Patent Application PI9404096.6, of authorship of the applicant of the present invention, proposes a method which makes use of two tubings connected to one to another in a region close to the bottom of the well. A mechanical interface is introduced into one of the tubings at the surface, and high-pressure gas is then injected into this tubing such as to cause movement of the mechanical interface along and within this tubing.

Driven by the gas, the mechanical interface passes through the entire tubing until it encounters a component which is situated near the bottom of the well and forms the interconnection with the other tubing. Still driven by the gas, the mechanical interface then commences ascent through the second tubing until it reaches the surface again. In its travel through the tubings it pushes to the surface the oil which is contained in the tubings.

This method constitutes a great step forward in petroleum recovery technique. However, because of its novelty, it becomes necessary to develop some adequate component which permits perfect interconnection of the tubings, thus ensuring leaktightness of the assembly.

The present invention proposes to make use of an adapter for oil well tubings which has the characteristics described above.

SUMMARY OF THE INVENTION

The present invention relates to a component called an adapter for oil well tubings, which is intended to assist the interconnection of two tubings in the interior of an oil well. Two types of adapters are proposed, one for use when the two tubings are not installed at the same time and the other for use when the tubings are installed simultaneously.

The first type has in its interior two bores intended for connection to the two tubings. One of the bores has a diameter equivalent to the inside diameter of the tubings and its top end is threaded to permit its connection to one of the tubings. The second bore has a diameter larger than that of the first and the contour of its inside surface permits the insertion into its interior, and the locking and sealing therein, of a tubing component connected to the end of the second tubing.

The second type of adapter according to the present invention has in its interior two bores intended to be connected to the tubings. The two bores have a common diameter equivalent to the inside diameter common to the two tubings, and their top ends are threaded.

In both types of oil well tubing adapters the inside surface of the bottom portion of the adapter is in the form of a cylindrical passage having a 180° bend segment whose diameter is equivalent to the inside diameter of the tubings. This configuration permits communication between the two orifices, thus making intercommunication between the tubings possible.

A connection in the bottom part of the adapter permits its interconnection to tubing conducting the ascending flow of oil coming from the production region, this flow passing into the interior of the tubing adapter by way of orifices existing in the internal part of the connection.

These orifices likewise prevent the passage of the mechanical interface to the bottom of the well, the occurrence of which would make it impossible to apply the intermittent production method with a mechanical interface.

BRIEF DESCRIPTION OF THE DRAWINGS

The characteristics of the adapter for oil well tubing in accordance with the present invention will be better seen from the detailed description given below, solely by way of example, taken in conjunction with the accompanying drawings, which are an integral part of the present specification, and in which.

DETAILED DESCRIPTION OF THE INVENTION

Figure 1:
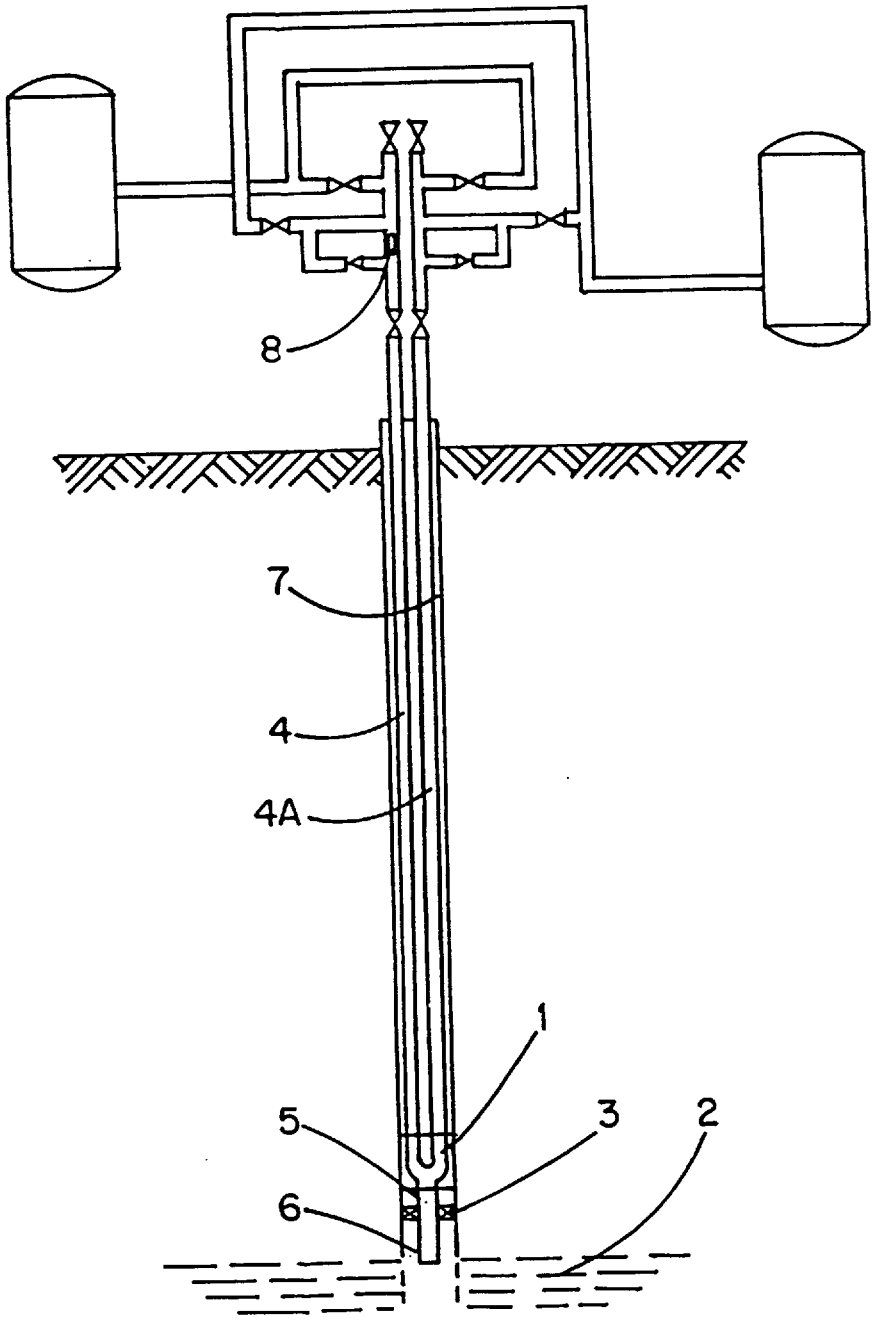
FIG. 1 is a schematic representation of a well fitted with equipment for the application of the intermittent production method with a mechanical interface, using a tubing adapter according to the present invention.

FIG. 1 shows a schematic representation of a well equipped for applying the intermittent production method with a mechanical interface. The mechanical interface 8 is shown still at the surface, above the two tubings 4, 4A and the well casing 7.

In a region situated slightly above the production region 2 the two tubings are interconnected by the tubing adapter 1, which in turn is interconnected to tubing 5. It should be pointed out that this tubing 5 may comprise various components which, solely for the sake of simplification, are not shown in the drawing because they do not form part of the present invention.

The only component of the tubing 5 shown in the figure is the check valve 6 which can be seen at the bottom end of the tubing 5. A packer 3 is responsible for sealing the annular space between the tubing 5 and the casing 7. There may be situations in which the packer 3 need not be used.

It can clearly be seen that the tubing adapter 1 is a component of fundamental importance for the perfect development of the intermittent production method using a mechanical interface because, in addition to ensuring perfect interconnection of the two tubings, it must be designed such that it does not hinder the passage of the mechanical interface 8 through its interior, and prevent its passing to the bottom of the well.

Two types of tubing adapters will be described in the present specification. The type of adapter shown in FIG. 2 must be used when the two tubings are not installed at the same time. The type of adapter shown in FIG. 3 must be used when the two tubings are installed simultaneously.

Figure 2:
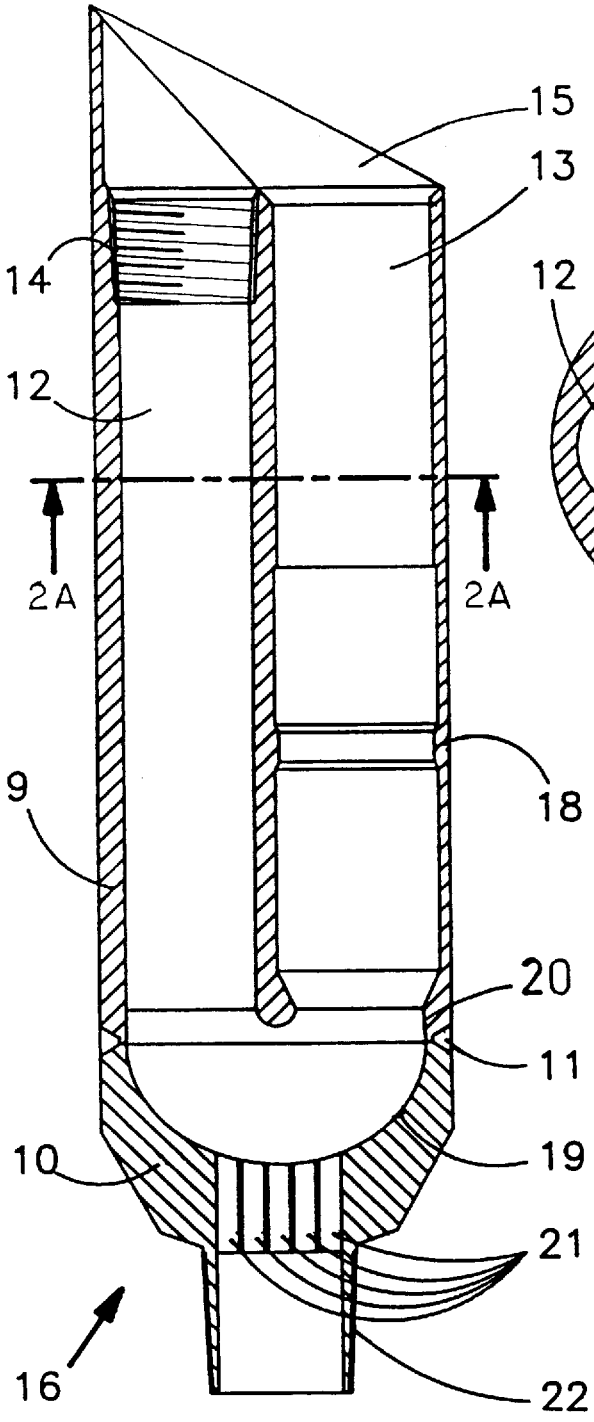
FIG. 2 is a view, in longitudinal section, of one type of oil well tubing adapter according to the present invention.

FIG. 2 shows a view, in longitudinal section, of one type of tubing adapter 16 according to the present invention, which has two longitudinal bores 12 and 13 intended for interconnection to the tubings such as 4 and 4A (not shown in the Figure).

Figure 2A:
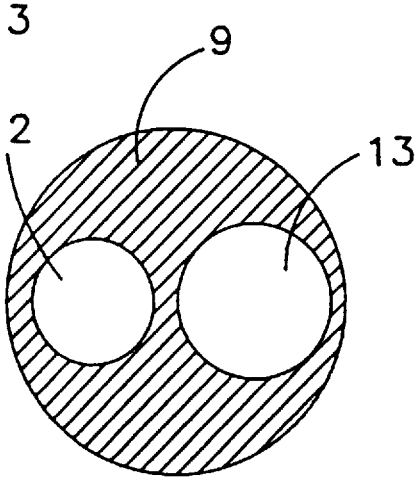
FIG. 2A is a sectional view of the adapter shown in FIG. 2.

The top end 14 of the longitudinal bore 12 is threaded to permit its connection to one of the tubings, an operation which must be carried out previously at the surface, before installation of the tubing in the well. The diameter of the bore 12 is equivalent to the inside diameter of the tubings such as 4, 4A to which it is to be connected. The diameter of the other bore 13 is larger than the diameter of the bore 12, as can be better seen in FIG. 2A.

The contours of the inside surface of the bore 13 must be designed such as to permit the insertion into its interior, the locking, and the sealing, of the tubing component which is connected to the end of the second tubing 4A and whose function is to assist the connection of the tubing 4A to the tubing adapter 16.

This component may for example be a device called by specialists a snap-latch seal nipple, which must be previously connected to the bottom end of the second tubing 4A before it is lowered inside the well for coupling to the tubing adapter 16.

Other tubing components may be used to connect the second tubing 4A to the tubing adapter 16, the snap-latch seal nipple having been suggested only because it is considered to be the most suitable already known tubing component for performing this function.

Thus, still in connection with FIG. 2, it was decided to illustrate the inside profile of the bore 13 in a form making it compatible with the outside profile of one type of snap-latch seal nipple. Inside the bore 13 there is then a zone 18 which has a reduced diameter and whose function is to serve as a locking stop for the snap-latch seal nipple. The region situated immediately below the zone 18 again has the same diameter as the region situated above said zone 18.

At the bottom end of the bore 13 is another region 20 of a reduced diameter, which is of the same size as the internal diameters of the tubings and of the snap-latch seal nipple, so that a single passage diameter is maintained in the entire assembly.

It is once again stressed that the description of the inside profile of the bore 13 given in the preceding paragraphs is merely to be illustrative in character and relates directly to one known type of snap-latch seal nipple. Consequently, the description of the profile of the bore 13 given above cannot in any way be considered as limiting the scope of the present invention.

At the top end of the tubing adapter 16 is an upstanding wall section 15 having a rim extending obliquely relative to the longitudinal axis of the adapter 16 and intended to serve as a guide for the snap-latch seal nipple during the connection of the second tubing 4A to the adapter.

The inside surface 19 of the bottom portion of the tubing adapter 16 is in the form of a concave segment, which interconnects the two bores 12 and 13. Its cross sectional shape and cross-sectional area are the same of that of the two tubings and of the bore 12. This concave segment is preferably a segment of a 180° bend cylindrical passage whose diameter is equivalent to the inside diameter of the two tubings 4,4A.

A connection 22 situated in the bottom part of the tubing adapter 16 permits its interconnection to the tubing 5 which conveys the ascending flow of oil coming from the production region. This tubing is not shown in the Figure. Oil coming from the production region flows off through the interior of this tubing 5 and passes into the interior of the tubing adapter 16 via orifices 21 which serve a dual function because, in addition to permitting the ascending outflow of the produced oil, they prevent the undesirable passage of the mechanical interface 8 to the bottom of the well.

The tubing adapter 16 must be installed inside the well, after it has been connected to one of the tubings 4 or 4A by means of the end 14 of the bore 12. After completion of the installation of the first tubing, the operation of installing the second tubing inside the well is then carried out.

At the end of this operation the two tubings 4, 4A are firmly interconnected, and the well will be ready for the application of the intermittent production method by means of a mechanical interface 8.

In the present embodiment it is suggested that the body of the tubing adapter 16 should be composed of two coaxial blocks 9 and 10 joined by a weld seam 11. Use may be made of other means for interconnecting the blocks 9 and 10, the weld seam having been chosen solely for economy and simplification in the process of manufacturing the tubing adapter 16.

Figure 3:
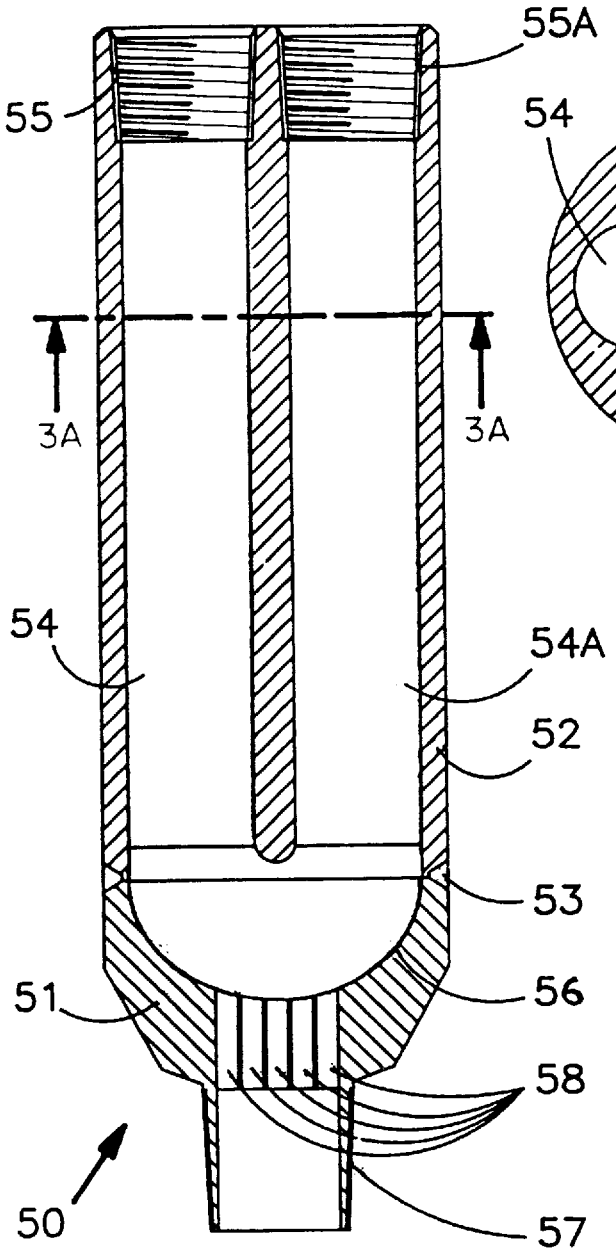
FIG. 3 is a view, in longitudinal section of another type of oil well tubing adapter according to the present invention.
Figure 3A:
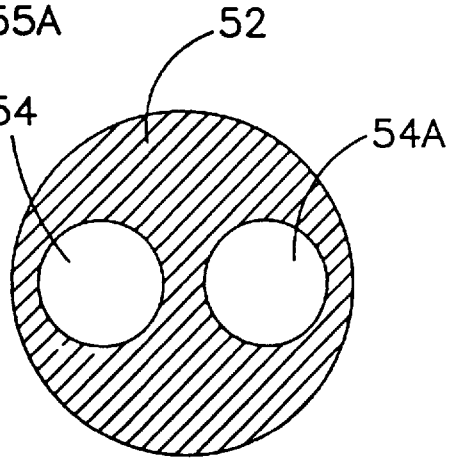
FIG. 3A is a sectional view of the adapter shown in FIG. 3.

FIG. 3 illustrates a second version 50 of the tubing adapter, which must be used when the two tubings are installed simultaneously. In its interior the tubing adapter 50 has two longitudinal bores 54 and 54A intended to assist the interconnection of the two tubings such as 4, 4A which are not shown in the Figure. The diameters of the two bores 54, 54A are equal to one another and equivalent to the inside diameter of the tubings 4, 4A, as can better be seen in FIG. 3A.

Still with regard to FIG. 3, it can be seen that the bottom inside surface 56 of the tubing adapter 50 is in the form of a concave segment which interconnects the two orifices 54 and 54A. This concave segment is preferably a segment of a 180° bend cylindrical passage whose diameter is equivalent to the inside diameter of the two bores 54, 54A and of the two tubings 4, 4A.

A connection 57 at the bottom part of the tubing adapter 50 permits its interconnection to the tubing 5 which conducts the ascending flow of oil coming from the production region. This tubing 5 is not shown in the Figure. The oil coming from the production region flows off through the interior of this tubing and passes into the interior of the tubing adapter 50 via orifices 58 which (as in the case of the orifices 21 of FIG. 2) serve a dual function because, in addition to permitting the ascending outflow of the oil produced, they prevent the undesirable passage of the mechanical interface 8 to the bottom of the well.

The top ends 55, 55A of the orifices 54, 54A are threaded to permit their connection to the two tubings. This operation must be carried out at the surface, before the installation of the tubings 4, 4A inside the well.

In the present embodiment it is suggested that the body of the adapter 50 should be formed by the union of two coaxial blocks 51 and 52 joined by a weld seam 53. Use may be made of other means for interconnecting the blocks 51 and 52, the use of a weld seam having been chosen solely for economy and simplification in the process of manufacturing the adapter 50.

What is claimed:

1. An adaptor for oil well tubings comprising first and second interior bores for interconnecting two tubings of an oil well, said first bore having a diameter equivalent to an inside diameter of one of said two tubings with a top end of the first bore threaded to permit connection to said one of said two tubings, said second bore having interior surface contours for permitting insertion therein of an end of the other of said two tubings, said adaptor having a bottom portion with a concave interior passage interconnecting said first and second bores and a connection connected to said passage in the bottom portion of said adaptor for permitting interconnection of said adaptor to an additional tubing which conducts an ascending flow of oil from a production region beneath said adaptor, said connection being provided with a plurality of orifices to permit the flow of oil into the interior of said adaptor while preventing passage of a mechanical interface into said additional tubing.

2. An adaptor as set forth in claim 1, wherein said concave passage interconnecting said first and second bores defines a cylindrical passage having a 180° bend through said adaptor, said passage having a diameter equivalent to interior diameters of each of said tubings.

3. An adaptor as set forth in claim 2, wherein said second bore has a zone disposed in an intermediate region of its longitudinal extent and having a reduced diameter to serve as a locking stop for a tubing component adapted to be connected to the end of the other of said two tubings, said second bore having at a bottom end thereof a region having a reduced diameter.

4. An adaptor as set forth in claim 3, wherein said adaptor is comprised of a two part body joined by means of a weld seam.

5. An adaptor for oil well tubings comprising first and second bores for interconnecting two tubings of an oil well, said first and second bores each having a diameter equivalent to an inside diameter of said tubings respectively with top ends of said first and second bores being threaded to permit connection to said two tubings, said adaptor having a bottom portion with a concave interior passage interconnecting said first and second bores and a connection connected to said passage in the bottom portion of the adaptor for permitting interconnection to an additional tubing which conducts an ascending flow of oil from a production region beneath the adaptor, said connection being provided with a plurality of orifices to permit the flow of oil into said adaptor while preventing passage of a mechanical interface from said adaptor to said additional tubing.

6. An adaptor according to claim 5, wherein said concave passage interconnecting said first and second bores defines a cylindrical passage having a 180° bend through said adaptor, said passage having a diameter equivalent to the diameter of said two tubings.

7. An adaptor as set forth in claim 6, wherein said adaptor is comprised of a two part body joined by means of a weld seam.

* * * * *